US007402740B2

(12) United States Patent
van der Meulen

(10) Patent No.: US 7,402,740 B2
(45) Date of Patent: Jul. 22, 2008

(54) TUNING SYSTEM FOR PERCUSSION INSTRUMENT

(75) Inventor: Jan Roelof van der Meulen, Brunssum (NL)

(73) Assignee: Pearl Musical Instruments Co., Chiba (JP)

( * ) Notice: Subject to any disclaimer, the term of this patent is extended or adjusted under 35 U.S.C. 154(b) by 0 days.

(21) Appl. No.: 11/637,778

(22) Filed: Dec. 13, 2006

(65) Prior Publication Data

US 2008/0141846 A1 Jun. 19, 2008

(51) Int. Cl.
*G10D 13/02* (2006.01)

(52) U.S. Cl. ..... 84/413; 84/411 R; 84/421

(58) Field of Classification Search ..... 84/411 R, 84/421, 413; 411/209
See application file for complete search history.

(56) References Cited

U.S. PATENT DOCUMENTS 3,125,190 A * 3/1964 Brennan ..... 52/295
4,122,747 A 10/1978 Yamashita
4,216,695 A * 8/1980 Hoshino ..... 84/421
4,362,449 A * 12/1982 Hlinsky ..... 411/156
4,526,083 A * 7/1985 LeMert ..... 84/421
4,619,559 A * 10/1986 Norris ..... 405/259.1
4,787,793 A * 11/1988 Harris ..... 411/339
4,960,028 A * 10/1990 Ramirez ..... 84/421
4,967,634 A * 11/1990 Whynott ..... 84/413
4,969,788 A * 11/1990 Goiny ..... 411/428
4,991,412 A * 2/1991 Bauer et al. ..... 68/23.1
5,007,746 A * 4/1991 Matzelle et al. ..... 384/420
5,349,891 A 9/1994 Belli
5,380,323 A * 1/1995 Howland ..... 606/61
5,404,785 A 4/1995 Belli
5,857,817 A * 1/1999 Giannuzzi et al. ..... 411/82.3
5,967,723 A * 10/1999 Duran ..... 411/121
6,018,116 A * 1/2000 Simons et al. ..... 84/411 R
6,091,011 A 7/2000 Simons et al.
6,106,190 A * 8/2000 Nakamura et al. ..... 403/408.1
6,278,045 B1 * 8/2001 Reyes ..... 84/411 R
6,372,972 B1 4/2002 Meinl
6,489,547 B2 12/2002 Chang
6,686,527 B2 * 2/2004 Hagiwara ..... 84/413

(Continued)

OTHER PUBLICATIONS

Tab, Key, and Notch Washers, distrubuted by Seastrom Manufacturing Company © 2003. http://www.seastrom-mfg.com/Seastrom_Manufacturing_Catalog/TabNotch.htm, viewed Jan. 2, 2008.*

*Primary Examiner*—Lincoln Donovan
*Assistant Examiner*—Robert W Horn
(74) *Attorney, Agent, or Firm*—Berenato, White & Stavish

(57) ABSTRACT

A tuning mechanism for tuning a drum having a head and a shell. The tuning mechanism includes a tuning bracket or receptacle mounted to the shell with a stabilizing portion formed thereon. A tuning rod has a first end attached to the head of the drum for varying the tension on the head and a second end passing through the tuning bracket and fitted with a nut for varying the applied tension to the head of the drum. Further a stabilizing washer positioned between the nut and the tuning bracket to improve a tuning procedure for said drum, whereby the stabilizer washer has a stabilizing tang that engages the stabilizing portion on the tuning bracket to prevent unwanted contact between the threads of the tuning rod and other structure of the percussion instrument.

7 Claims, 4 Drawing Sheets

U.S. PATENT DOCUMENTS 6,700,045 B2 * 3/2004 Del Valhe ..... 84/413
6,949,702 B2 9/2005 Ortega et al.
7,192,234 B2 * 3/2007 Anderson et al. ..... 411/533
D541,330 S * 4/2007 Lombardi ..... D17/22
7,291,777 B2 * 11/2007 Chen ..... 84/421
2002/0005106 A1 1/2002 Payerl
2006/0207406 A1 * 9/2006 Kennedy ..... 84/411 R

* cited by examiner

TUNING SYSTEM FOR PERCUSSION INSTRUMENT

FIELD OF THE INVENTION

The present invention relates to musical instruments and, more particularly, to a tuning system for drums and the like such as congas, bongos, djembe and other musical drums. It particularly relates to a simplified improvement in the construction of a tuning lug and the receptacle affixed to the drum body for overcoming difficulties presented in the tuning of such drums.

DESCRIPTION OF RELATED ART

It will be understood that the tuning mechanisms involved with drums are commonly made from steel including a threaded rod and nut which are adjusted to vary the tension on the drum head. In a particular case of the above-noted musical drums, external tuning devices have been provided and these protrude from the side of the drum shell. Due to the large external forces required to tune by stretching the head (made of skin or a synthetic material), the tuning mechanisms tend to be large and obtrusive.

The pitch of a drum is determined by the tension on the drumhead. While the tension on the drumhead is adjustable, adjustment of the head tension is a time consuming process. FIG. 1 shows a typical arrangement for a drumhead attachment. A drum 10 consists of a drum barrel 12 and a drumhead 14, which is positioned on top of barrel 12. The head 14 has a downwardly extending annular portion 16 that covers the top opening of barrel 12. A hoop 18 extends outwardly from annular portion 16.

A tensioning ring 20 is placed over the annular portion 16 of the head 14. Ring 20 enables a tensioning force to be applied evenly to the annular portion 16 of the drumhead 14. Bracket 22 is attached to the ring 20 via fasteners 24 or is integrally formed as part of the ring 20 to form a hook receiving opening.

A lug 28 hooks over bracket 22 and transfers a tensioning force thereto. The tensioning force is transferred to the bracket 22, through ring 20, and to hoop 18 and portion 16 of head 14. The tensioning force is created by nuts 30, which are threaded against a bottom 32. Bottom 32 abuts a collar 34 that is fixed to barrel 12 via flange 36 and fasteners 24. A washer 38 is placed between one or more nut(s) and the bottom 32. If two nuts 30 are used, the upper nut 30 serves to increase or decrease the amount of tension applied by lug 28, while the lower nut 30 serves as a locking nut to hold a set tension, i.e., pitch of the drum, at a desired setting. Typically there is only one nut 30. However, two nuts 30 can be used but they will make the tuning procedure more cumbersome.

Known drums use a plurality of the above-described lug assemblies, such as six assemblies, to tension the drumhead 14. Tightening or loosening all of the lugs 28 to vary the tension on drumhead 14 is a time consuming process. Moreover, to preserve drumhead 14 it is recommended to loosen nuts 30 after each use, requiring the drummer to retighten the nuts 30 to the desired tuning tension the next time the drum is used. Such a procedure is cumbersome and consequently not followed in many instances, placing undue stress on both the drumhead 14 and the barrel 12.

A need therefore exists for a tuning mechanism that allows the drummer to efficiently tighten and loosen the tension on the drumhead 14.

SUMMARY OF THE INVENTION

A tuning mechanism for tuning a drum having a head and a shell. The tuning mechanism comprises a tuning bracket or receptacle mounted to the shell with a stabilizing portion formed thereon. A tuning rod has a first end attached to the head of the drum for varying the tension on the head and a second end passing through the tuning bracket and fitted with a nut for varying the applied tension to the head of the drum. Further a stabilizing washer positioned between the nut and the tuning bracket to improve a tuning procedure for said drum, whereby the stabilizer washer has a stabilizing tang that engages the stabilizing portion on the tuning bracket.

DETAILED DESCRIPTION OF PREFERRED EMBODIMENT

Figure 2:
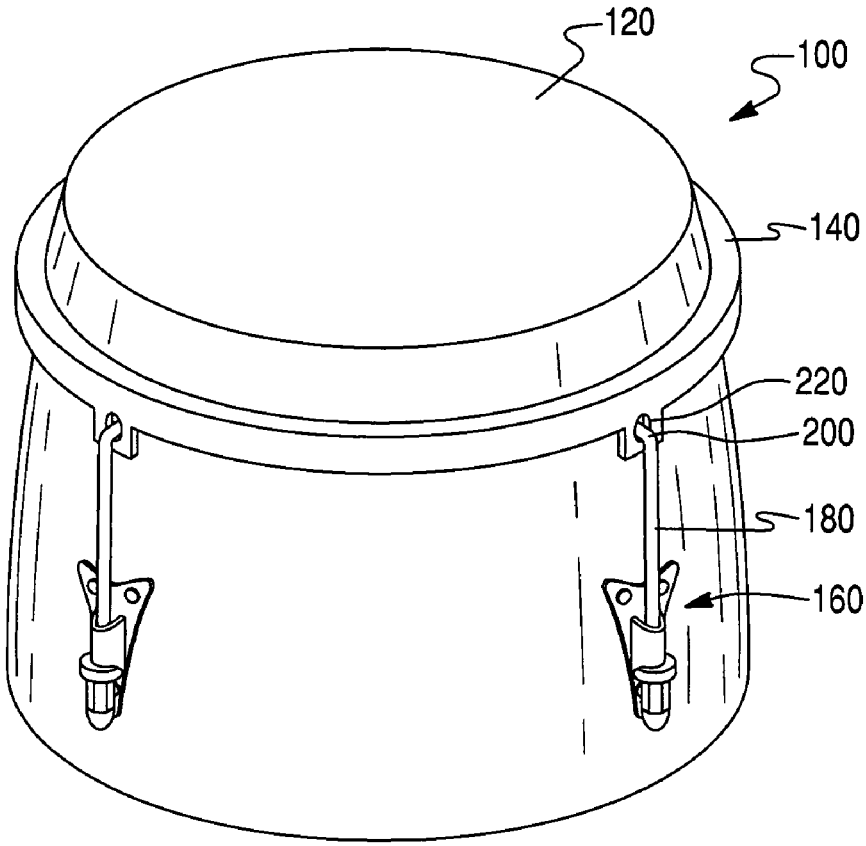
FIG. 2 is a perspective view of a conventional drum incorporating the tuning mechanism of the present invention.

Referring now to the Figures of the drawing and particularly to FIG. 2, the drums 100 as illustrated for explaining the present invention can, of course, be made in a variety of shapes and from a variety of materials. Each of the drums 100 is constructed to have a drum head 120 composed of skin, or alternately, of synthetic material. The skin is maintained in a conventional manner within a ring 140. The skin is gripped, whereby tension can be applied for tuning purposes, the tuning being accomplished by reason of tuning mechanisms 160 spaced around the periphery of each of the drums, usually four, five or six in number.

Figure 1:
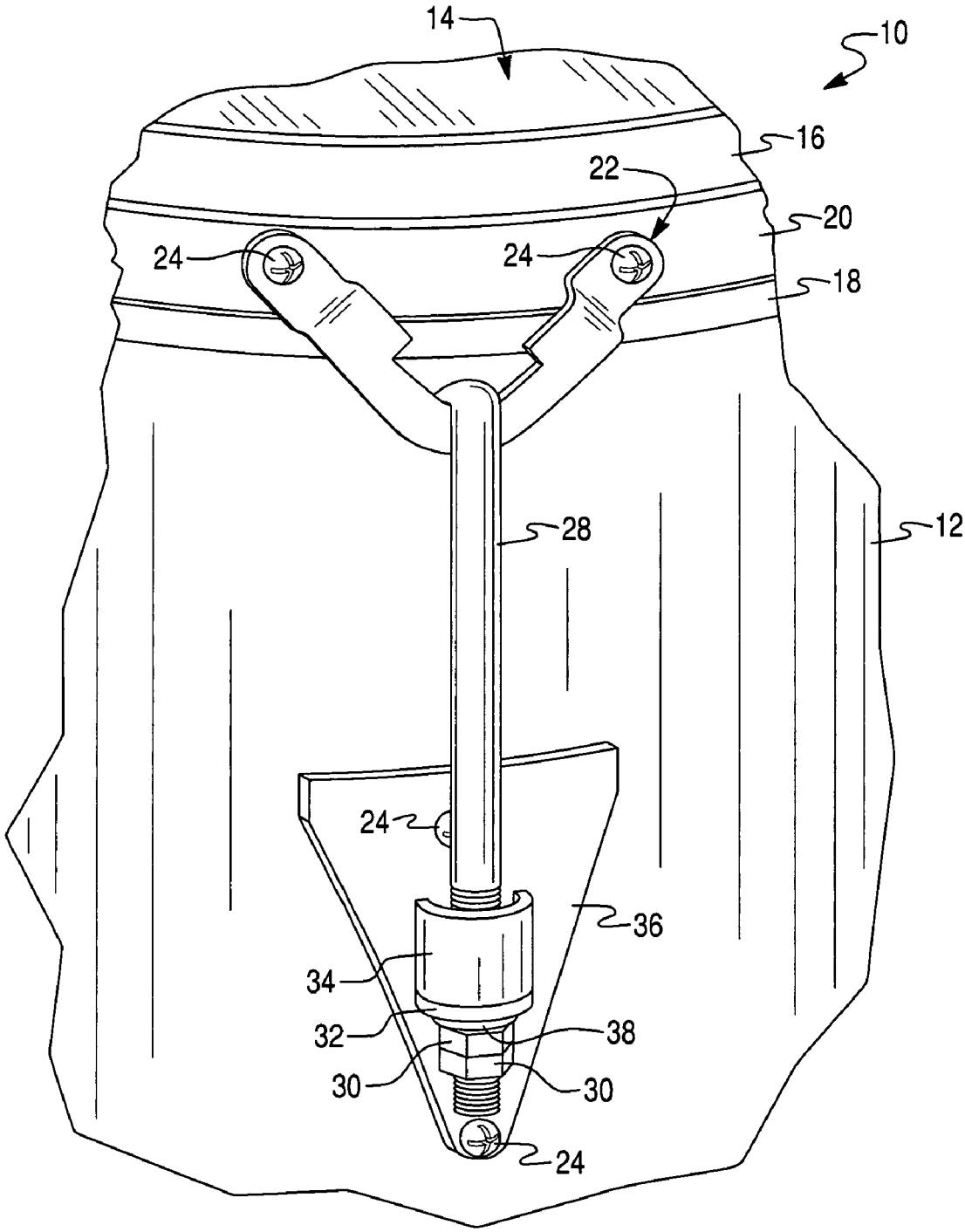
Fig. 1 Prior Art
FIG. 1 is a perspective view of a section of a prior art configuration for tensioning a drumhead.

Each of the tuning mechanisms 160, which serve to vary the skin tension completely around the ring 140, includes a rod 180 which is provided, at its upper end, with a hook 200 fitting into an opening 220 in a boss or other hook (see FIG. 1) formed integrally with the ring 140. The rod 180, forming part of the mechanism 160, is received in a tuning bracket or receptacle 130 and extends through the tuning bracket so as to be engaged with a washer 132 and a nut 134. The nut 134 is selectively moved along the threads 136 of the rod 180 to adjust the tuning of a given drum by applying greater or lesser tension to the head 120 of the drum through the action of ring 140. It will be clear that the tuning bracket 130 is an integral part of a tuning bracket plate 137 which functions to enable attachment of the tuning mechanism 160 by suitable rivets or the like to the shell of the drum. Of course, other types and forms of the tuning bracket performing the same function will be apparent to those of skill in the art.

Uniquely designed in accordance with the present invention is the stabilizing washer 300 for stabilizing the components of the tuning mechanism 160 during the tuning operation. Instead of having physical contact between the threads 136 of the rod 180 and the tuning bracket 130, a simple specially constructed stabilizing washer 300 has been devised and its relationship to other elements established, such that by this simple structure the tuning mechanism 160 is easier to operate. More specifically and as will be described below, the stabilizing washer 300 interacts with the tuning bracket 130 to stabilize the tuning operation.

Figure 4:
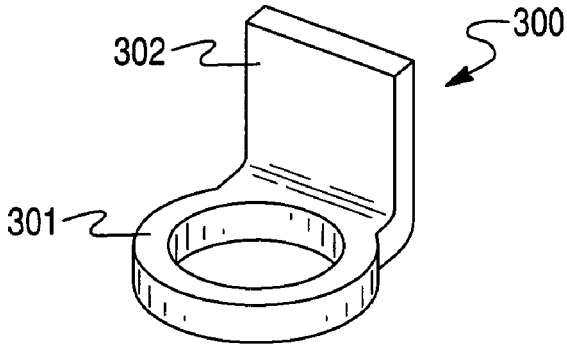
FIG. 4 is an enlarged perspective view of the stabilizing washer according to the present invention.
Figure 5:
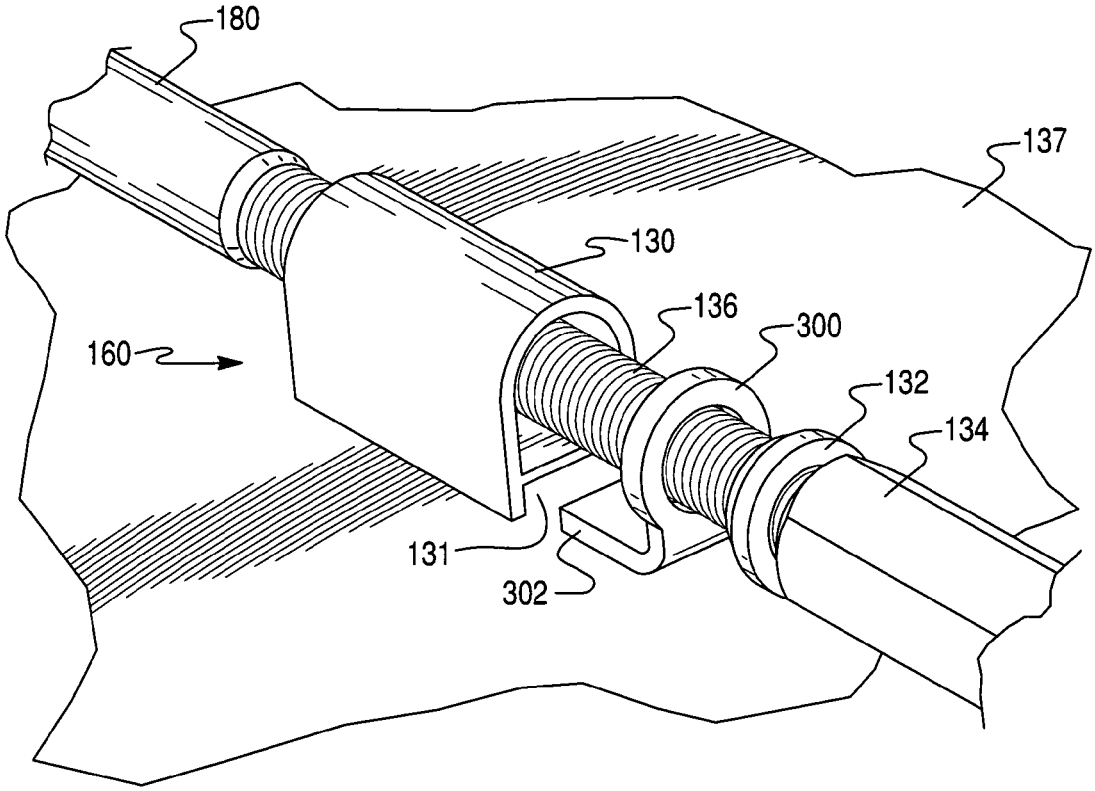
FIG. 5 is an enlarged view of the stabilizing washer interacting with the stabilizing portion of the tuning bracket mounted to the drum shell.

Thus, as will be seen in FIG. 5, the stabilizer device is in the form of a special, stabilizing washer 300—basically of metal for strength but other suitable material will be apparent to those of skill in the art—is preferably placed in association with the tuning bracket 130 already described by having the stabilizing washer 300 interact with the tuning bracket 130 at its lower end to prevent contact between the threads 136 and the inside wall of the bracket 130. The stabilizing washer 300 essentially includes an annular ring 301 and stabilizing tab 302 integrally formed as an integral body. Of course, one of skill in the art will recognize that the stabilizing washer can be formed of multiple parts and with a configuration different form that shown FIGS. 3-5.

Figure 3:
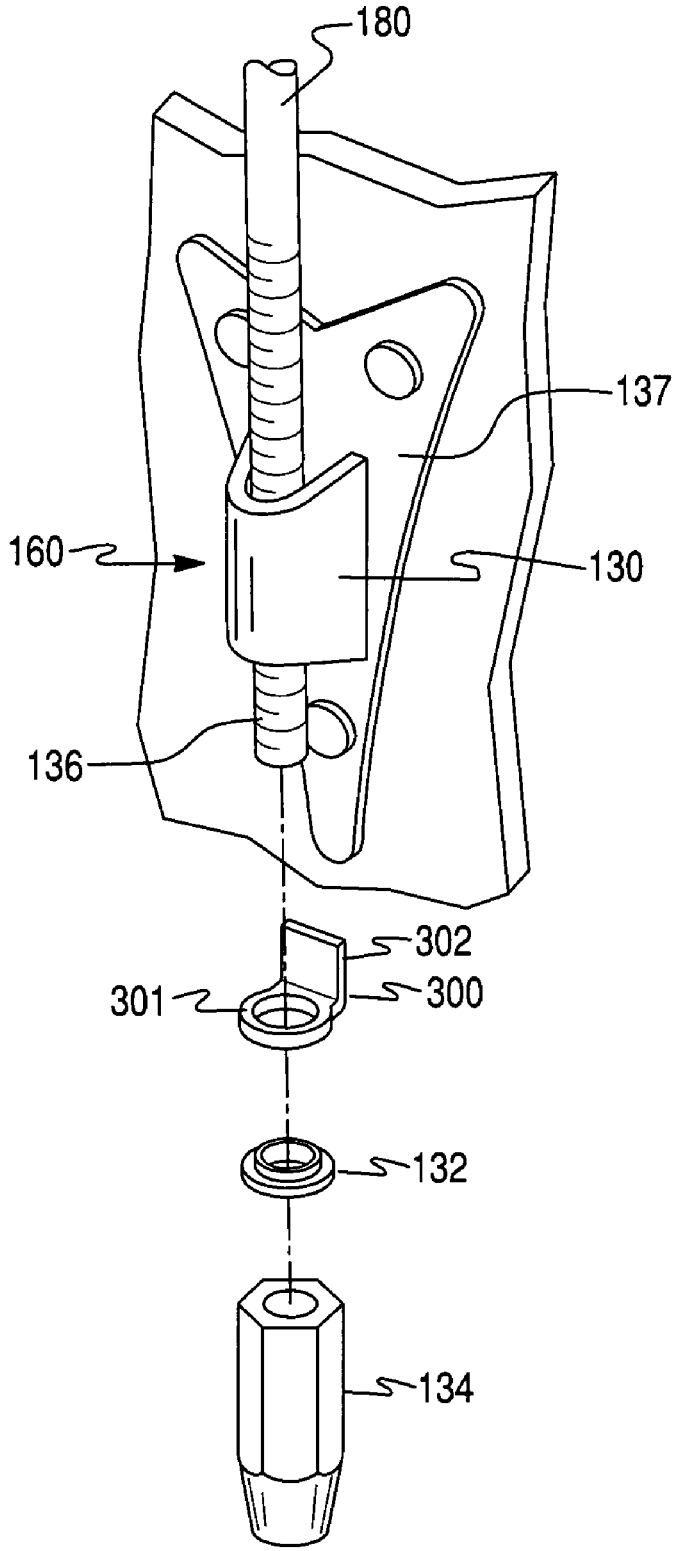
FIG. 3 is an exploded view of the tuning mechanism of the present invention.

As seen in detail in FIGS. 3-5, a specific embodiment of the stabilizing washer 300 and bracket 130 keeps the washer stationary which prevents the threads 136 of the tension rod 180 from contacting the inside of the tuning bracket 130 through the use a male-female interface, thus considerably improving the ease of tuning. More specifically, the tab 302 fits into the recess 131 at the bottom of the receptacle and keeps the washer 300 from moving relative to the receptacle and tuning plate 137. Of course, the invention may consist of any one of a variety of mechanical interfaces to stabilize the tension rod 180 and its threads 136 from engaging or rubbing against other structural member of the percussion instrument.

The invention having been thus described with particular reference to the preferred forms thereof, it will be obvious that various changes and modifications may be made therein without departing from the spirit and scope of the invention as defined in the appended claims.

The invention claimed is:

1. A tuning mechanism for tuning a musical drum having a head and a shell, said tuning mechanism comprising:

a tuning bracket mounted to said shell, said tuning bracket having a stabilizing portion;

a tuning rod having a first end secured to the head of said drum for varying the tension on the head, wherein said tuning rod is received in the tuning bracket;

a nut is secured to said second end of said tuning rod for varying the applied tension to the head of said one drum;

a washer positioned between said nut and said tuning bracket; and a stabilizing interface to prevent threads of said tuning rod from engaging said tuning bracket, wherein said stabilizing interface includes a stabilizing tang provided on said washer to engage a recess provided on said tuning bracket said tang being received in said recess to prevent contact between threads of said tuning rod and said tuning bracket and to improve a tuning procedure for said drum.

2. The tuning mechanism according to claim 1, wherein stabilizing interface is disposed between the washer and the tuning bracket to prevent threads of said tuning rod from engaging said tuning bracket.

3. The tuning mechanism according to claim 1, wherein stabilizing interface includes a male-female mechanical connection between the washer and the tuning bracket.

4. The tuning mechanism according to claim 1, wherein said recess of said stabilizing interface is partly formed by a wall formed on said tuning bracket, said wall being disposed between said tuning rod and said shell to prevent contact therebetween to improve a tuning procedure for said drum.

5. The tuning mechanism according to claim 1, wherein said washer includes an annular portion adapted to receive said tuning rod therethrough.

6. The tuning mechanism according to claim 5, wherein said recess defines a slot formed on said tuning bracket adapted to matingly receive said stabilizing tang.

7. The tuning mechanism according to claim 1, wherein the first end of the tuning rod is secured to the head of said drum by a hook-type connection.

* * * * *